US005978447A

United States Patent [19]

Carlson et al.

[11] Patent Number: 5,978,447

[45] Date of Patent: Nov. 2, 1999

[54] X-RAY TUBE STRADDLE BEARING ASSEMBLY

[75] Inventors: Gerald J. Carlson, Lombard; Jason P. Harris, Schaumburg, both of Ill.

[73] Assignee: Picker International, Inc., Highland Heights, Ohio

[21] Appl. No.: 08/967,475

[22] Filed: Nov. 11, 1997

[51] Int. Cl.[6] ..... H01J 35/10

[52] U.S. Cl. ..... 378/132; 378/127

[58] Field of Search ..... 378/119, 121, 378/125, 127, 128, 130, 131, 132

[56] References Cited

U.S. PATENT DOCUMENTS

| | | | |
|---|---|---|---|
| 3,942,059 | 3/1976 | Tran-Quang | 378/128 |
| 4,115,718 | 9/1978 | Eggelsmann | 378/128 |
| 4,468,800 | 8/1984 | Friedel et al. | 378/131 |
| 4,545,064 | 10/1985 | Klostermann | 378/132 |
| 5,224,142 | 6/1993 | Ono et al. | 378/128 |

FOREIGN PATENT DOCUMENTS

| | | | |
|---|---|---|---|
| 0078449 | 6/1980 | Japan | 378/128 |

*Primary Examiner*—David P. Porta

*Attorney, Agent, or Firm*—Timothy B. Gurin; John J. Fry; Eugene E. Clair

[57] ABSTRACT

A rotating assembly 79 includes an anode assembly 55 coupled to a shaft 70 and a rotor 75 including a rotor body 77. The anode assembly 55 includes an elongated neck portion 58 and is rotated via the shaft 70 about an axis of rotation 65 in an x-ray tube 12. The shaft 70 is mounted by a straddle bearing assembly 68 having a bearing housing 100. The bearing housing 100 includes a first elongated portion 101 and second elongated portion 102, and a base portion 103. The first elongated portion 101 and the second elongated portion 102 each pass through a center of mass C of the rotating assembly 79 and define an cooling duct 119 for removing heat from the anode assembly 55 during operations. A first bearing 90*a* and a second bearing 90*b* are disposed in the bearing housing 100 on opposite sides of the center of mass C of the rotating assembly 79. The first bearing 90*a* and the second bearing 90*b* are received between inner races 82*a*, 82*b* defined by the shaft 70 and outer races 92*a*, 92*b* defined by an outer bearing member 94 adjacent the second elongated portion 102. The second bearing 90*b* is positioned such that it is always in a closer thermal conductive path to a peripheral edge of the anode assembly 55 than the first bearing 90*a* regardless of an amount of load of the rotating assembly 79 supported by the first or second bearing.

33 Claims, 5 Drawing Sheets

X-RAY TUBE STRADDLE BEARING ASSEMBLY

TECHNICAL FIELD

The present invention relates to x-ray tube arts. It finds particular application in conjunction with x-ray tube bearing assemblies and will be described with particular reference thereto. It is to be appreciated, however, that the invention may also find application in conjunction with bearing assemblies in other applications, and the like.

BACKGROUND OF THE INVENTION

Conventional diagnostic use of x-radiation includes the form of radiography, in which a still shadow image of the patient is produced on x-ray film, fluoroscopy, in which a visible real time shadow light image is produced by low intensity x-rays impinging on a fluorescent screen after passing through the patient, and computed tomography (CT) in which complete patient images are electrically reconstructed from x-rays produced by a high powered x-ray tube rotated about a patient's body.

In a typical x-ray tube, electrons are generated from a filament coil heated to thermionic emission. The electrons are accelerated as a beam from a cathode through an evacuated chamber defined by a glass envelope, toward an anode. When the electrons strike the anode with large kinetic energies and experience a sudden deceleration, x-radiation is produced. An x-ray tube assembly is contained in a housing which includes a window transmissive to x-rays, such that radiation from the anode passes through the window toward a subject undergoing examination or treatment.

Most x-ray tube designs employ filaments as a source of electrons. A filament is a coil of wire which is electrically energized so that electrons are thermionically emitted from the filament. The electrons are accelerated toward the anode due to a DC electrical potential difference between the cathode and the anode. Often this electrical potential difference is of the order of 150,000 volts, (±75,000 volts to ground) necessitating significant electrical insulation between the various tube components.

In some low power x-ray tubes, electrons from a cathode filament are drawn at a high voltage to a stationary target anode. The impact of the electrons causes the generation of x-rays as well as significant thermal energy. In higher power x-ray tubes the thermal energy produced at the stationary target anode often becomes so large that the generated heat became a limiting factor in x-ray tube performance.

In order to distribute the thermal loading and reduce anode temperature a rotating anode configuration has been adopted for many applications. In this configuration, an electron beam is focused near a peripheral edge of the anode disk at a focal spot. As the anode rotates, a different portion of a circular path around the peripheral edge of the anode passes through the focal spot where x-rays are generated. Each portion along the circular path is heated to a very high temperature during the generation of x-rays and cooled as it is rotated before returning for the generation of x-rays. As higher power x-ray tubes are developed, the diameter and the mass of the rotating anode continues to grow. Further, when x-ray tubes are combined with conventional CT scanners, a gantry holding the x-ray tube is rotated around a patient's body in order to obtain complete images of the patient. Today, typical CT scanners revolve the x-ray tube around the patient's body at a rate of between 60–120 rotations-per-minute (RPM). In order for the x-ray tube to properly operate, the anode needs to be properly supported and stabilized from the effects of its own rotation and, in some instances, from centrifugal forces created by rotation of the x-ray tube about a patient's body.

Typically, the anode is mounted on a stem and rotated by a motor. The anode, stem and other components rotated by the motor are part of a rotating assembly which is supported by a bearing assembly. The bearing assemblies found in most x-ray tubes today utilize either a cantilevered bearing arrangement or a straddle bearing arrangement. In a cantilevered bearing arrangement, all bearings are located on the same side of the rotating assembly's center of mass. In a straddle bearing arrangement, bearings are located on both sides of the rotating assembly's center of mass.

One drawback to using the cantilevered bearing arrangement is that a bearing closest to the anode experiences a much greater load than the bearing(s) further from the anode. The bearing closest to the anode therefore has greater contact stresses which deleteriously effects the life of the entire bearing assembly and thus the x-ray tube life. If the size of the bearings closest to the anode were increased to distribute the contact stresses, the internal surface speeds of this bearing would increase and the bearing life would decrease due to a faster wear rate. Thus, the bearing closest to the anode would still typically fail first.

In an effort to more equally distribute the load of the rotating assembly among the bearings, the straddle bearing arrangement was developed. Typical straddle bearing arrangements employ a large bearing-to-bearing distance. The bearing-to-bearing distance is sometimes referred to as a straddle or wheelbase. The large wheelbase is required to thermally insulate the bearings from the anode which is typically very hot. The anode is often in the range of 1200 degrees C. Heat from the anode is thermally conducted to the bearings through the predominantly metal bearing assembly.

In conventional straddle bearing designs, heat transferred from the anode substantially equally effects each bearing on either side of the anode. This is the case since the bearings are typically symmetrically spaced an equidistance from the anode's center of mass in order to share the load equally, and since the thermally conductive path between the anode and each bearing is the same length. Because each bearing on either side of the anode must be moved out an equal distance from the anode's center of mass for thermal insulation purposes, the wheelbase of a conventional straddle bearing assembly is typically much larger than a wheelbase found in a cantilevered bearing arrangement. As discussed above, bearings in a cantilevered bearing arrangement are all on the same side of the anode. Thus, in a cantilevered bearing arrangement, once the bearing closest to the anode is thermally insulated the other bearing(s) can be placed at an appropriate distance further away from the bearing closest to the anode. This is possible since the thermally conductive path to the other bearings is always further than the thermally conductive path to the bearing closest to the anode. Therefore, thermal insulation does not require the large wheelbase in a cantilevered bearing arrangement that it does in a conventional straddle bearing arrangement.

An unfortunate drawback to having a large wheelbase is that thermal compensation becomes much more difficult. Thermal compensation relates to the accommodations made in the bearing assembly in both the radial and axial directions to account for changes in bearing tolerances caused by temperature variances. The larger the wheelbase, the more thermal growth and shrinkage the bearing assembly design must be able to withstand. Thus, designing for thermal compensation in a straddle bearing assembly is extremely difficult given the large wheelbases dictated by the need to thermally insulate the bearings.

One common technique used in both cantilevered and straddle bearing arrangements to ensure predictability in the effect temperature swings have on the bearing assembly is to only allow thermal movement in the bearing assembly to occur in one direction as opposed to compensating for thermal movement symmetrically about the bearing. This is typically done by securing in place at least one end of each component of the bearing assembly such that thermal shrinkage and growth occurs in a known direction at the opposite end. As a consequence, as components coupled to the bearing assembly expand and contract due to temperature variances, the anode also moves thereby creating changes to the focal spot. More specifically, as most conventional bearing assemblies restrict thermal expansion and contraction to occur in a direction substantially parallel with an axis of rotation of the anode, thermal movements typically cause the focal spot to change is size. Such change in size to the focal spot is undesirable as it causes blurring to images taken from the x-rays radiating from the anode. Further, such thermal expansion and contraction also causes undesired movement of the focal spot with respect to x-ray detectors outside of the x-ray tube which may additionally deleteriously effect the quality of the images taken.

Typical implementations of straddle bearing designs also employ an outer bearing race rotation. Inner bearing race rotation is not available in straddle bearing designs as aligning bearings on opposite sides of the anode to handle such inner bearing race rotation has not been achievable. Aligning the bearings is difficult primarily because outer races for each bearing must be independently positioned on opposite sides of the anode in conventional straddle bearing designs and slight deviations from perfectly symmetrically placement of the outer bearings causes the anode supported by the bearing assembly to wobble during operation. Unfortunately, outer bearing race rotation increases surface speeds in the bearing and therefore increases the wear on the bearings. Further, because bearings in a straddle bearing assembly are physically located on both sides of the anode, difficulties arise in electrically isolating the bearings from high voltages. Specifically, if an x-ray tube is configured in a bi-polar arrangement, the cathode would be at a −75,000 volt potential while the anode would be at a +75,000 volt potential. As the bearing assembly is coupled to the anode assembly, the bearings are at the anode voltage potential. However, in a conventional straddle bearing assembly, at least one of the bearings is in close proximity to the cathode and therefor needs to be electrically insulated from the cathode voltage potentials in order to avoid undesirous arcing from occurring. As insulating the bearing from the cathode voltage potential is normally too difficult to accomplish, x-ray tube having a straddle bearing assembly typically implement a single ended configuration where the anode is at ground potential and the cathode is at −150,000 volts. Unfortunately this makes it difficult for such x-ray tubes to be used in a retrofit manner since most x-ray tube generators are configured to handle only a bi-polar topology.

Therefore, what is needed is a bearing assembly wherein each bearing of the bearing assembly is capable of supporting a substantially equal load while still overcoming the shortfalls discussed above related to both cantilevered and straddled bearing assemblies.

SUMMARY OF THE INVENTION

In accordance with the present invention, a straddle bearing assembly is provided. The straddle bearing assembly includes a first bearing and a second bearing disposed in a bearing housing on opposite sides of a center of mass of a rotating assembly. The rotating assembly including a target. A first thermally conductive path between the first bearing and the target includes a second thermally conductive path between the second bearing and the target.

In accordance with another aspect of the present invention, an x-ray tube straddle bearing is provided. The x-ray tube straddle bearing assembly includes a housing and a plurality of bearings disposed in the housing for rotatably supporting a rotating assembly. The housing includes a first elongated portion, a second elongated portion coupled to the first elongated portion, and a base portion coupled to the second elongated portion. The first elongated portion and the second elongated portion pass through a center of mass of the rotating assembly.

In accordance with another aspect of the present invention, an x-ray tube is provided. The x-ray tube includes a cathode assembly, an anode assembly, and an envelope encompassing at least a portion of the cathode assembly and at least a portion of the anode assembly. The envelope defines a substantially evacuated chamber in which the cathode assembly and the anode assembly may operate to produce x-rays. The x-ray tube also includes a straddle bearing assembly rotatably supporting the anode assembly, the straddle bearing assembly providing an inner bearing race rotation.

In accordance with yet another aspect of the present invention, an apparatus for taking images of a patient is provided. The apparatus for taking images of a patient includes an x-ray tube and a means for supporting the x-ray tube. The x-ray tube includes a cathode assembly, a rotating assembly which includes an anode assembly, an envelope defining a substantially evacuated chamber in which the cathode assembly and the anode assembly may operate to produce x-rays and a bearing assembly. The bearing assembly includes a first bearing disposed in a bearing housing on a first side of a center of mass of the rotating assembly and coupled to the anode assembly via a first thermally conductive path, and a second bearing disposed in the bearing housing on an opposite side of the center of mass of the rotating assembly and coupled to the anode assembly via a second thermally conductive path. The second thermally conductive path is longer then the first thermally conductive path independent of an amount of load of the rotating assembly supported by the second bearing.

In accordance with yet another aspect of the present invention an x-ray tube straddle bearing assembly is provided. The x-ray tube straddle bearing assembly supports a rotating assembly which includes a target. The x-ray tube straddle bearing assembly includes a bearing housing, a first bearing disposed in the bearing housing and coupled to the target via a first thermally conductive path, the first bearing positioned on a first side of a center of mass of the rotating assembly, and a second bearing disposed in the bearing housing and coupled to the target via a second thermally conductive path, the second bearing positioned on an opposite side of the center of mass of the rotating assembly. The first bearing supports less of a load of the rotating assembly than the second bearing and the first thermally conductive path is shorter than the second thermally conductive path.

In accordance with still another aspect of the present invention a method of improving performance of an x-ray tube bearing assembly is provided. The x-ray tube includes a rotating assembly and a cathode assembly. The rotating assembly includes an anode assembly and a shaft coupled to the anode assembly. The shaft is rotatably supported by a bearing assembly and defines a first inner race and a second inner race. The method includes the steps of positioning a first bearing between the first inner race and a first outer race of the bearing assembly, the first bearing positioned on a first side of a center of mass of the rotating assembly, positioning a second bearing between the second inner race and a second outer race of the bearing assembly, the second bearing positioned on an opposite side of the center of mass of the rotating assembly; and rotating the shaft about an axis of rotation.

In accordance with yet another aspect of the present invention a method of improving performance of an x-ray tube bearing assembly is provided. The method includes the steps of positioning a first bearing of the bearing assembly on a first side of a center of mass of a rotating assembly, the rotating assembly including an anode assembly, and positioning a second bearing of the bearing assembly on an opposite side of the center of mass of the rotating assembly such that independent of an amount of load of the rotating assembly supported by the second bearing, the first bearing is in a closer thermal conductive path to the anode assembly than the second bearing.

One advantage of the present invention is that it provides for a straddle bearing design which allows inner bearing race rotation thereby minimizing wear on the bearings.

Another advantage of the present invention is that each bearing is capable of substantially supporting an equal amount of load of the rotating assembly without requiring a large wheelbase between the bearings thereby reducing the amount of thermal compensation needed for the bearing assembly.

Still a further advantage of the present invention is that the anode assembly does not substantially move during thermal heating and cooling of components in the x-ray tube thereby maintaining a steady size and location of the focal spot on the anode assembly.

Yet another advantage of the present invention is that the bearing closer by way of a thermally conductive path to the anode assembly may be situated to support less load of the rotating assembly than the bearing situated further away from the anode assembly in a straddle bearing assembly.

Still another advantage of the present invention is that the design of the bearing assembly defines a cooling duct whereby oil or other coolant may flow to absorb heat thermally radiated from the anode assembly and cool the outer bearing races.

To the accomplishment of the foregoing and related ends, the invention then, comprises the features hereinafter fully described and particularly pointed out in the claims. The following description and the annexed drawings set forth in detail certain illustrative embodiment of the invention. These embodiments are indicative, however, of but a few of the various ways in which the principles of the invention may be employed. Other objects, advantages and novel features of the invention will become apparent from the following detailed description of the invention when considered in conjunction with the drawings.

DETAILED DESCRIPTION OF THE PREFERRED EMBODIMENTS

Figure 1:
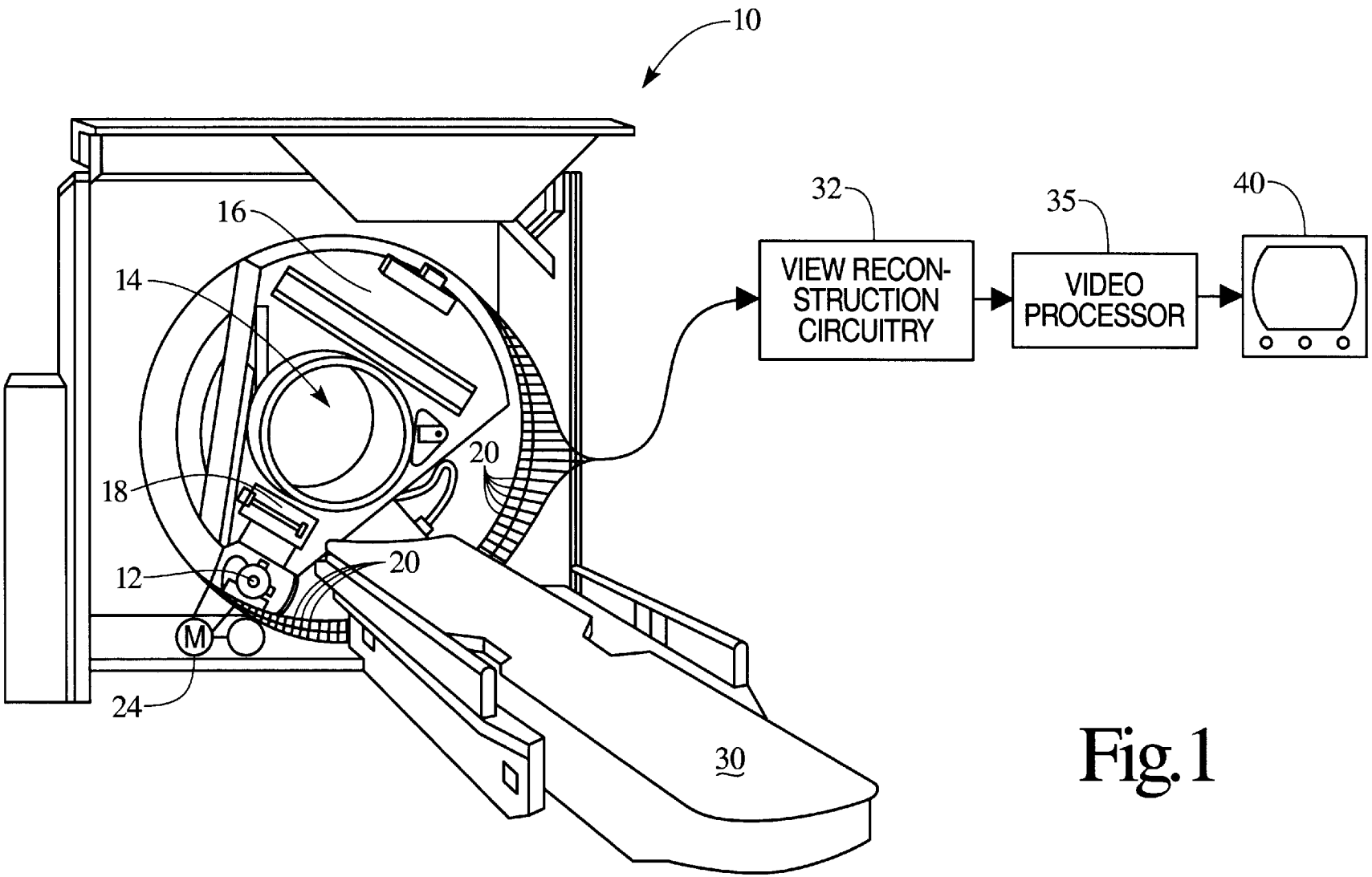
FIG. 1 is a diagrammatic illustration of a CT scanner in accordance with the present invention.

The present invention will now be described with reference to the drawings in which like reference numerals are used to refer to like elements throughout. Referring now to FIG. 1, a CT scanner 10 includes a radiation source 12, such as an x-ray tube, for projecting a fan beam of radiation through an examination region or scan circle 14. The x-ray tube 12 is mounted on a rotatable gantry 16 to rotate the fan beam of radiation around the examination region 14. A collimator and shutter assembly 18 collimates the radiation to one or more planer beams and selectively gates the beams on and off. Radiation detectors 20 are mounted peripherally around the examination region 14 and detect the radiation for processing. A motor 24 provides motive power for rotating the gantry 16 continuously around the examination region 14.

A patient support 30 supports a patient subject in a reclined position. The patient support 30 is advanced through the examination region 14, preferably at a constant velocity. As the patient support 30 moves through the examination region 14, the x-ray tube 12 is rotated about the patient support 30 to ensure a complete set of information is available for reconstruction.

The detectors 20 are coupled to view reconstruction circuitry 30. The view reconstruction circuitry 30 stores and processes data received from the detectors 20 and maintains selected slice and volumetric images of the patient. A video processor 35 retrieves image information from the view reconstruction circuitry 30 and formats the image data into appropriate formats for display on video monitor 40 or the like.

Figure 2:
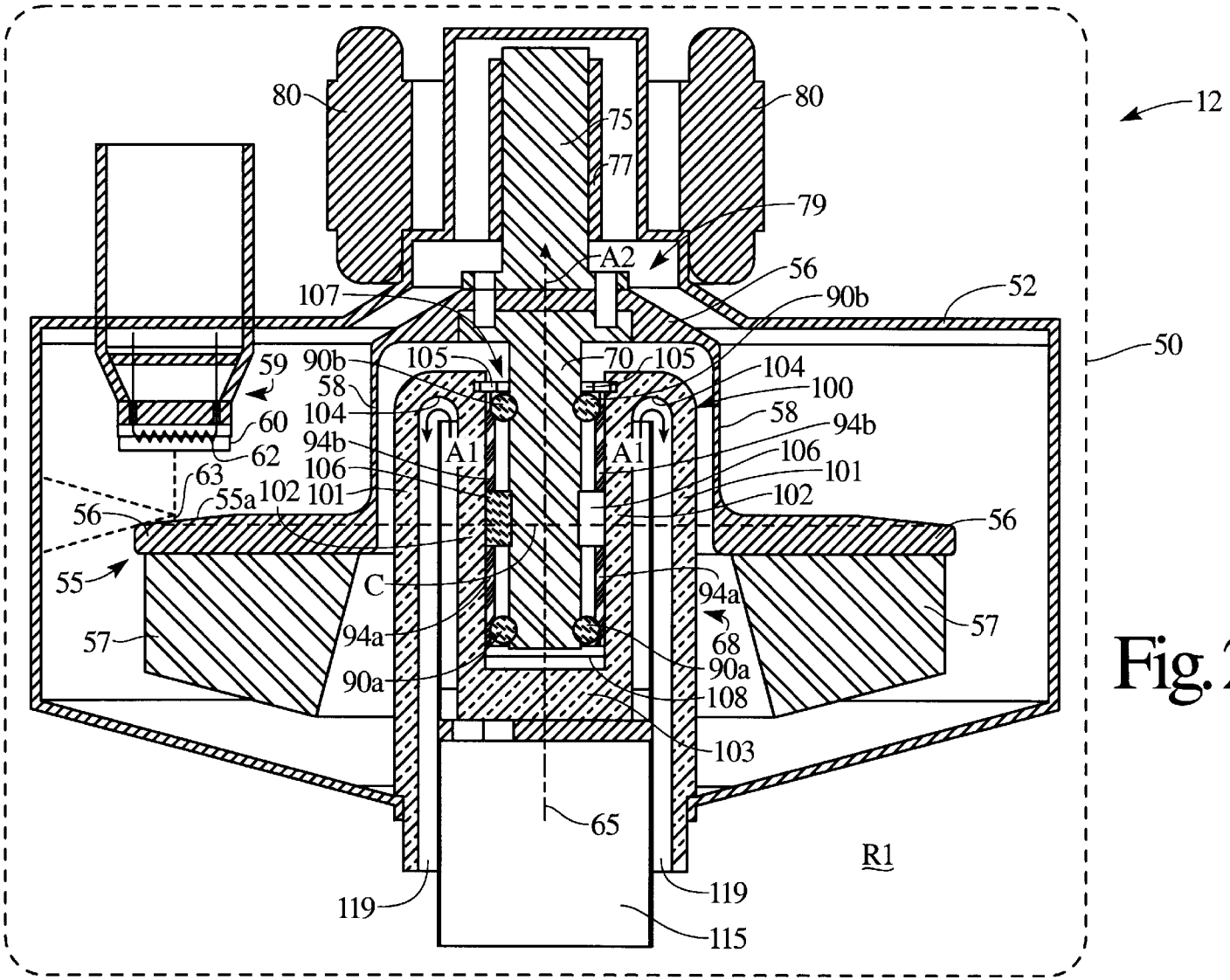
FIG. 2 is a top cross sectional view of an x-ray tube in accordance with the present invention.

Referring to FIG. 2, the x-ray tube 12 of the present invention is shown in more detail. The x-ray tube 12 includes a housing 50 filled with a heat transfer and electrically insulating fluid such as oil. Supported within the housing 50 is an envelope 52, typically comprised of glass or metal, within which an evacuated chamber or vacuum is defined. Disposed within the envelope 52 is an anode assembly 55 and a cathode assembly 59. The anode assembly 55 is shown to be comprised of a molybdenum alloy front plate 56 and a graphite back plate 57. The front plate 56 of the anode assembly includes an anode surface 55*a* facing a cathode focusing cup 60 of the cathode assembly 55. A portion of the anode surface 55*a* closest a focal spot 63 is made of a tungsten and rhenium composite in order to aid in the production of x-ray. Further, the front plate 56 of the anode assembly 55 includes an elongated neck portion 58 as discussed in more detail below. It will be appreciated, however, that other single or multiple piece anode configurations made of any suitable substances could alternatively be used.

As is well known in the art, a cathode filament 62 mounted to the cathode focusing cup 60 is energized to emit electrons which are accelerated to the anode assembly 55 to produce x-radiation for diagnostic imaging, therapy treatment and the like. The cathode focusing cup 60 serves to focus electrons emitted from the cathode filament 62 to the focal spot 63 on the anode surface 55*a*. The electrons are emitted from the cathode filament 62 and accelerated toward the anode assembly 55 due to a very large DC electrical potential difference between the cathode focusing cup 60 and the anode assembly 55. In the present embodiment, the cathode focusing cup 60 is at an electrical potential of −75,000 volts to with respect to ground, and the anode assembly 55 is at an electrical potential of +75,000 volts with respect to ground thereby providing a bipolar configuration having a total electrical potential difference of 150,000 volts. Impact of the electrons from the cathode filament 62 onto the anode surface 55*a* typically causes the anode assembly 55 to be heated to a range of between 1100°–1400° C.

Figure 3:
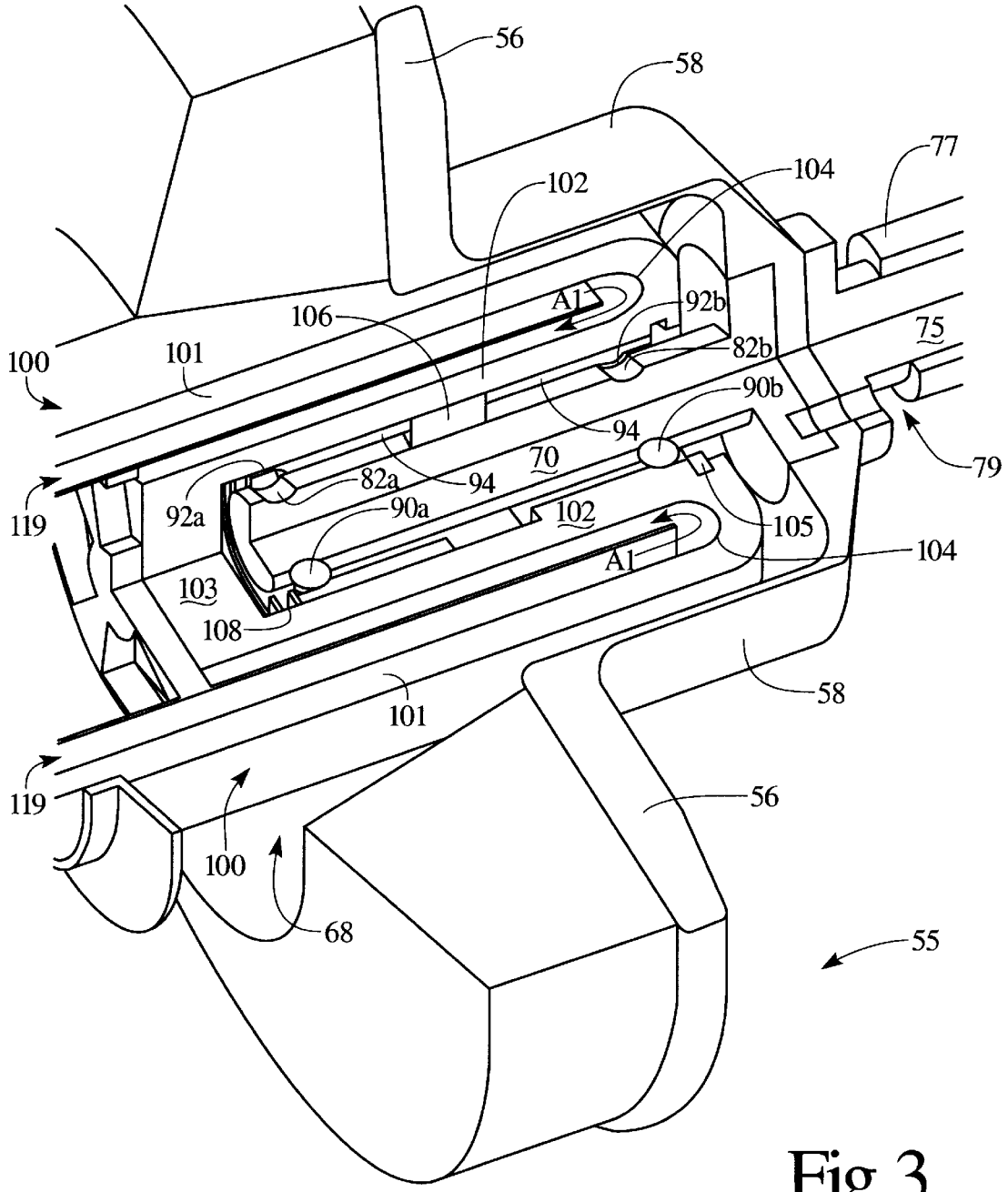
FIG. 3 is a three-quarters isometric view of a straddle bearing assembly of the x-ray tube shown in FIG. 2.

Referring now to FIGS. 2 and 3, the x-ray tube anode assembly 55 is mounted for rotation about an axis 65 via a straddle bearing assembly shown generally at 68. More specifically, the front plate 56 of the anode assembly 55 is rigidly coupled to shaft 70 and rotor 75. The rotor 75 includes a rotor body 77 which is coupled to induction motor 80 for rotating the shaft 70 and anode assembly 55 about the axis 65. All of the components rotated by the motor 80, including the rotor 75, rotor body 77, shaft 70 and anode assembly 55 are hereinafter referred to as rotating assembly 79. The straddle bearing assembly 68 supports a load of the rotating assembly 79 during rotation. The load of the rotating assembly 79 includes the weight of all of the components of the rotating assembly 79 including the weight of the anode assembly 55.

As shown in FIG. 3, the shaft 70 defines a pair of inner races 82*a*, 82*b*. A plurality of ball or other bearing members 90*a* are received between the inner bearing race 82*a* and an outer bearing race 92*a* defined by an outer bearing member 94*a*. Similarly, a plurality of ball or other bearing members 90*b* are received between the inner bearing race 82*b* and an outer bearing race 92*b* defined by an outer bearing member 94*b*. The bearings 90*a*, 90*b* provide for rotation of the anode assembly 55 about the axis 65. Each bearing 90*a* and 90*b* is situated on an opposite side of a center of mass of the rotating assembly 79 along the axis 65. The center of mass of the rotating assembly 79 is shown along dashed line C (FIG. 2).

A bearing housing 100 includes a first elongated portion 101, a second elongated portion 102, a base portion 103, and U shaped bend 104. Both the first elongated portion 101 and the second elongated portion 102 are substantially parallel to the axis 65 and pass through the center of mass C of the rotating assembly 79. The first elongated portion 101 and second elongated portion 102 of the bearing housing 100 which are coupled together at the U shaped bend 104 define a cooling duct 119. The bearing housing 100 of the present embodiment is made of copper, however, it will be appreciated that other suitable materials could alternatively be used.

Each outer bearing members 94*a* and 94*b* is cylindrical in shape and spaced apart from one another by a spacer 106. The outer bearing members 94*a* and 94*b* and spacer 106 are positioned within a cavity 107 defined by the elongated portion 102 and base portion 103 of the bearing housing 100. A retaining spring 108 is positioned within the cavity 107 adjacent the base portion 103 of the bearing housing 100 and a snap ring 105 is rigidly secured to the elongated portion 102 of the bearing housing 100 at an opposite end of the cavity 107. The retaining spring 108 and the snap ring 105 serve to frictionally sandwich and secure the outer bearing members 94*a* and 94*b* and spacer 106 within the cavity 107. Similar to the bearing housing 100, the outer bearing members 94*a* and 94*b* and the spacer 106 are made of copper although other suitable materials could alternatively be used.

As best seen in FIG. 2, the x-ray tube 12 further includes an oil nozzle 115. The nozzle 115 serves to pump oil in a direction indicated by arrows A1 through the cooling duct 120. The oil pumped by the nozzle 115 is obtained from a region R1 between the envelope 52 and x-ray tube housing 50. As the oil travels through the cooling duct 120 along a path adjacent the elongated portion 102 of the bearing housing 100, the oil serves to remove heat from the outer bearing members 94*a* and 94*b* thereby reducing thermal stress placed on bearings 90*a* and 90*b*.Further, as oil continues to flow through the cooling duct 120 and passes along a path adjacent the elongated portion 101 of the bearing housing 100, the oil serves to absorb heat radiated from the front plate 56 and back plate 57 of the anode assembly 55. The oil flowing thorough the cooling duct 120 is typically flowing at a rate of approximately three gallons per minute although this rate may optionally be varied to obtain desired cooling effects. Further, although the present embodiment describes the nozzle 115 directing the flow of oil in the direction of arrows A1, it will be appreciated that the nozzle 115 may optionally reverse the flow of oil through the cooling duct 120.

Figure 4:
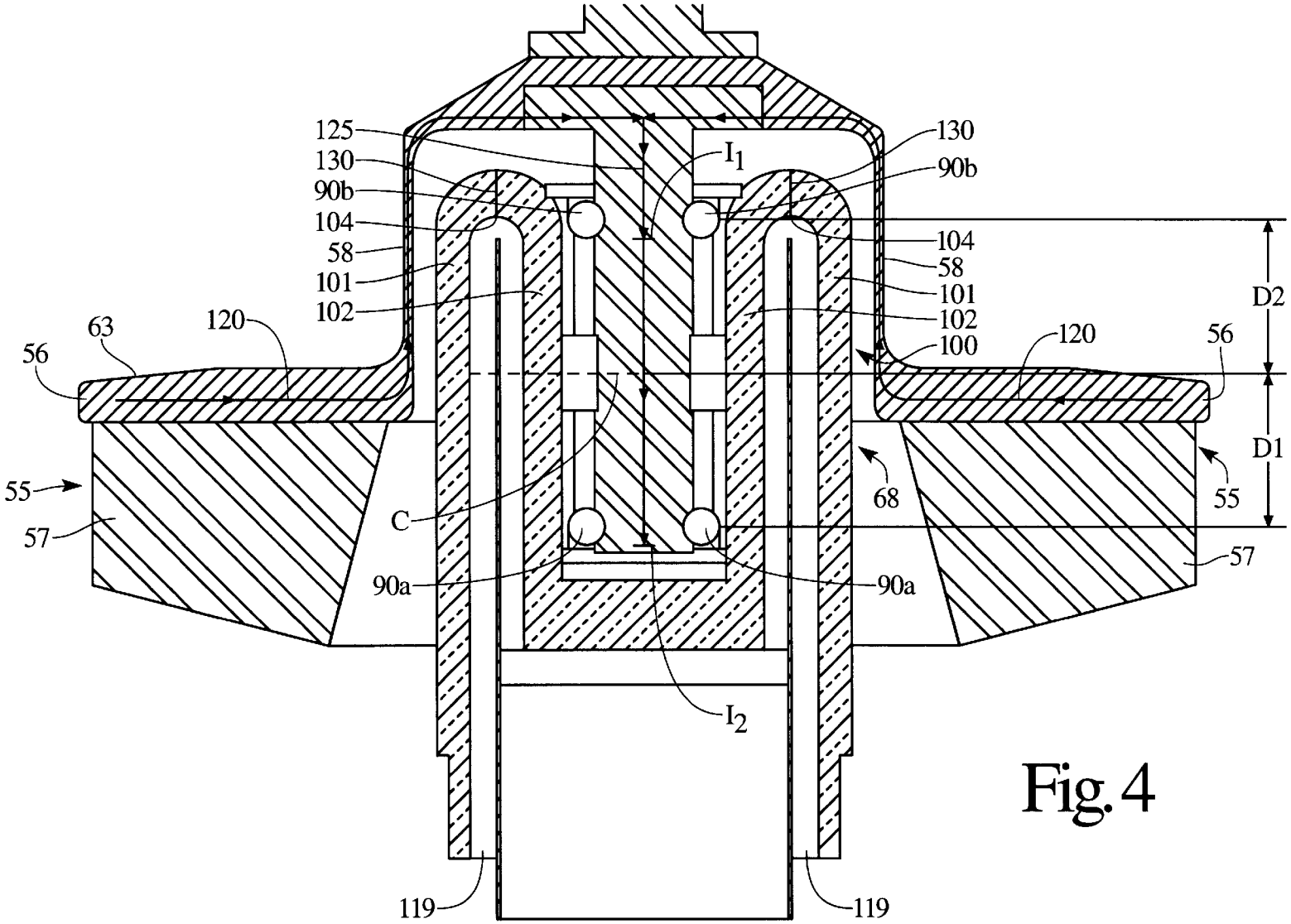
FIG. 4 is a top cross sectional view of the straddle bearing assembly of FIG. 3.

As shown in FIG. 4, heat from the anode assembly 55 is primarily passed to the bearings 90*a*, 90*b* via a thermally conductive path shown by arrowed paths 120 and 125. More specifically, arrowed path 120 begins at a peripheral edge of the anode assembly 55 which comes in contact with the electrons dissipated from the cathode filament 62 and travels along the elongated neck portion 58 of the anode assembly 55 to the shaft 70. Arrowed path 125 runs substantially parallel with the axis 65 of rotation of the shaft 70 and has two end indicators. The first end indicator is shown at I1 and indicates an end of a full thermally conductive path to the bearing 90*b* from the peripheral edge of the anode assembly 55. The second end indicator is shown at I2 and indicates an end of a full thermally conductive path to the bearing 90*a* from the peripheral edge of the anode assembly 55. For purposes of this invention, the term "thermally conductive path" and derivations thereof includes a path by way of which heat is transferred between two points other than a path through a vacuum, air, or gas.

It will be appreciated that in the straddle bearing assembly 68 of the present invention, the full thermally conductive path to the bearing 90*a* includes the full thermally conductive path to the bearing 90*b*. As the thermally conductive path to the bearing 90*a* is longer then the thermally conductive path to the bearing 90*b*, the bearing 90*a* will be at a cooler temperature then the bearing 90*b*. Therefore, once the bearing 90*b* is placed a sufficient distance along the thermally conductive path from the peripheral edge of the anode assembly 55 such that the heat dissipated to the bearing 90*b* in the region around I1 does not place undue temperature stress on the bearing 90*b*, bearing 90*a* is likewise protected. Further, because the anode assembly 55 includes the elongated neck portion 58, the thermally conductive path to the bearing 90*b* includes more area for heat from the anode assembly 55 to be dissipated via oil flowing through the cooling duct 119 thereby reducing thermal stresses placed on the bearings 90*a*, 90*b*. More specifically, as heat from the peripheral edge of the anode assembly 55 travels along the elongated neck portion 58, heat radiated from the elongated neck portion 58 may be absorbed through the elongated portion 101 of the bearing housing 100 into the oil flowing through the cooling duct 120. Thus, by providing more area between the peripheral edge of the anode assembly 55 and the bearings 90*a* and 90*b* where heat may be dissipated and absorbed by the oil, the present invention is able to reduce the thermal stress placed on the bearings 90*a* and 90*b* thereby extending their operational life and thus the operational life of the x-ray tube 12.

The wheelbase of the straddle bearing assembly 68 of the present invention is shown to be a distance of D1+D2 where D1 represents the distance between the bearing 90*a* and the center of mass C of the rotating assembly 79 and where D2 represents the distance between the bearing 90*b* and the center of mass C of the rotating assembly 79. In the present embodiment the distance D1 and D2 are substantially equal thereby providing that the bearing 90*a* and the bearing 90*b* each support a substantially equal load of the rotating assembly 79. Further, because the full thermally conductive path to the bearing 90*a* includes the full thermally conductive path to the bearing 90*b,* the wheelbase D1+D2 for bearings of a desired size, temperature and wear rate is significantly less than a wheelbase needed in a conventional straddle bearing assembly having bearings of similar characteristics. As discussed above, the wheelbase of conventional straddle bearing assemblies were often very large since thermal insulation from the anode assembly required the bearings to be placed along thermally conductive paths from the anode assembly that were opposite in direction from one another. Since the thermally conductive path for bearings 90*a,* 90*b* are not opposite in direction from one another in the present invention, such large wheelbases are not necessary. Thus, the wheelbase D1+D2 of the present invention is often less than 50% of the wheelbase needed in a conventional straddle bearing assembly having bearings of similar characteristics. This, in turn, allows for easy thermal compensation of the bearing assembly 68. As discussed above in the background section, large wheelbases are undesirable since compensating the bearing assembly for thermal expansion and contraction is difficult with larger wheelbases. As the present invention does not require such a large wheel base to obtain similar wear rates on bearings of comparable size and temperature, design difficulties associated with needing to thermally compensate for large temperature variances is avoided.

It will be appreciated, that although the present embodiment shows the distance D1 and D2 between each bearing 90*a,* 90*b,* respectively, to be substantially equal in length, the present invention allows for the distances D1 and D2 to be independently varied to desired lengths. For instance, in order to account for the fact that the bearing 90*b* is located along a shorter thermally conductive path to the peripheral edge of the anode assembly 55 than the bearing 90*a* and therefore is subjected to higher thermal stress, the bearing 90*a* may be moved into a position closer to the center of mass C of the rotating assembly 79 than the bearing 90*b*. In other words distance D1 is shorter than distance D2. Since the distance D1 is shorter than the distance D2, the bearing 90*a* supports a larger load of the rotating assembly 79 than the bearing 90*b*. This in turn offsets some or all of the effects the higher temperature stress has on the bearing 90*b* thereby providing a bearing assembly 68 in which both bearings 90*a* and 90*b* wear at approximately the same rate so that the life of the bearing assembly 68 is maximized.

Even though the bearings 90*a* and 90*b* are on opposite sides of the center of mass C of the rotating assembly 79, the bearings 90*a* and 90*b* are both also positioned on a same side of the anode assembly 55 relative the front plate 56. More specifically, as shown in FIG. 2 the front plate 56 of the anode assembly 55 follows along the elongated neck portion 58 and through a junction between the anode assembly 55 and the rotor 75. Thus, the bearings 90*a* and 90*b* are both positioned on a side of the front plate 56 of the anode assembly 55 opposite the side facing the cathode cup 60. As such, the x-ray tube 12 may be configured with a bipolar arrangement since neither of the bearings 90*a,* 90*b* of the straddle bearing assembly 68 are directly exposed to the electric field of the cathode assembly 55 and therefore additional electrical insulation with respect to the cathode assembly 55 is not necessary.

In operation, the motor 80 (FIG. 2) rotates the rotor 75 which is rigidly attached to the anode assembly 55. The anode assembly 55 is in turn rigidly attached to the shaft 70. As such, the anode assembly 55 and shaft 70 are both rotated about the axis 65 while supported by the straddle bearing assembly 68. The bearings 90*a,* 90*b* of the present invention are both rotated via an inner bearing race rotation by shaft 70. Inner bearing race rotation involves rotating the inner races 82*a,* 82*b* (FIG. 3) of the bearing assembly 68 while maintaining the outer races 92*a,* 92*b* in a stationary position. As the inner races 82*a,* 82*b* are defined by the shaft 70, inner bearing race rotation is achieved in the present embodiment by rotating the shaft 70. Inner bearing race rotation minimizes surface speeds leading to wear on the bearings 90*a,* 90*b* since a single rotation of the anode assembly 55 causes less movement with respect to the bearings 90*a,* 90*b* than outer bearing race rotation. More specifically, with inner bearing race rotation, a single rotation of the anode assembly 55 only causes rotation of the bearings 90*a,* 90*b* to an extent of movement of the inner races 82*a,* 82*b* which is defined by a circumference of the shaft 70. With outer bearing race rotation, a single rotation of the anode assembly 55 causes rotation of the bearings 90*a,* 90*b* to an extent of movement of the outer races 92*a,* 92*b* which is defined by a circumference of the outer bearing members 94*a,* 94*b*. Since the circumference of the outer bearing members 94*a,* 94*b* is longer than the circumference of shaft 70, a single rotation of the anode assembly 55 by way of the inner races provides less rotational movement of the bearings 90*a,* 90*b* than would outer race rotation. Therefore, inner bearing race rotation leads to less wear on the bearings 90*a,* 90*b* and thus prolongs the life of the x-ray tube 12.

Inner bearing race rotation is available in the present invention given the relationship between the straddle bearing assembly 68 and the anode assembly 55. More specifically, the straddle bearing assembly 68 provides both bearings 90*a* and 90*b* of the present invention to be located on the same side of the anode assembly 55. As such, symmetrically aligning the outer races 92*a,* 92*b* to handle inner race rotation without wobble is relatively easy since both outer bearing members 94*a* and 94*b* are precisely positioned within the cavity 107 predefined by the bearing housing 100. By comparison, in a conventional straddle bearing assembly each bearing is placed on an opposite side of the anode assembly. Therefore, if inner bearing race rotation were attempted, the outer bearing races for each bearing would have to be independently aligned since a one piece bearing housing could not extend to both sides of the anode assembly. As discussed in the background section, such independent alignment of the outer bearing races in a straddle bearing design has not been achievable.

As the anode assembly 55 heats during operation of the x-ray tube 12, the shaft 70 thermally expands in a direction indicated by arrow A2 (FIG. 2). Thermal expansion of the shaft 70 in an opposite direction of arrow A2 is not possible given that an opposite end of the shaft 70 closest to the bearing 90*a* is situated against the base portion 103 of the bearing housing 100 which is fixed in place. As the anode assembly 55 is rigidly coupled to the shaft 70, thermal expansion of the shaft 70 also causes the front plate 56 of the anode assembly 55 to move in the direction of arrow A2. However, the present invention provides a counter balance for the thermal expansion in the shaft 70. More specifically, as the elongated neck portion 58 of the anode assembly 55 thermally expands, the front plate 56 of the anode assembly 55 is caused to move in a direction opposite the direction of arrow A2. Thermal expansion of the elongated neck portion 58 causes expansion in the direction opposite the arrow A2 since the front palate 56 and back plate 57 of the anode assembly 55 are not fixed or restrained from movement by any component of the x-ray tube 12 in this direction. Thus, the positioning of the front plate 56 of the anode assembly 55 remains substantially stationary during temperature changes in the x-ray tube. As such, the focal spot 63 on the anode surface 55*a* also remains a substantially constant size regardless of the heating and cooling effects of the anode assembly 55 and bearing assembly 68. Further, the focal spot 63 does not substantially move with respect to x-ray detectors (not shown) outside of the x-ray tube 12.

In an alternative embodiment of the present invention, the bearing housing 100 of the x-ray tube 12 is made of sections which are glass and sections which are copper to help aid in cooling the anode assembly 55. More specifically, as shown in FIG. 4, the elongated portion 101 is made of glass and the elongated portion 102 and base portion 103 are made of copper. The elongated portion 101 and the elongated portion 102 are joined together using known techniques such as brazing or welding at a junction 130 along the U shaped bend 104 of the bearing housing 100. It will be appreciated, however, that the junction between glass and copper could be made at any desirable location along the elongated stems 101 and 102. By providing the bearing housing 100 with a glass portion along the elongated portion 101, heat thermally radiated from the front plate 56 and back plate 57 of the anode assembly 55 is more readily absorbed by the oil flowing through the cooling duct 119. Thus, the anode assembly 55 is better able to be cooled and less heat is thermally conducted and radiated to the bearings 90*a* and 90*b*. It will be appreciated that the bearing housing may be comprised of other materials including metals such as copper and molybdenum and ceramics such as alumina and beryllia.

Figure 5:
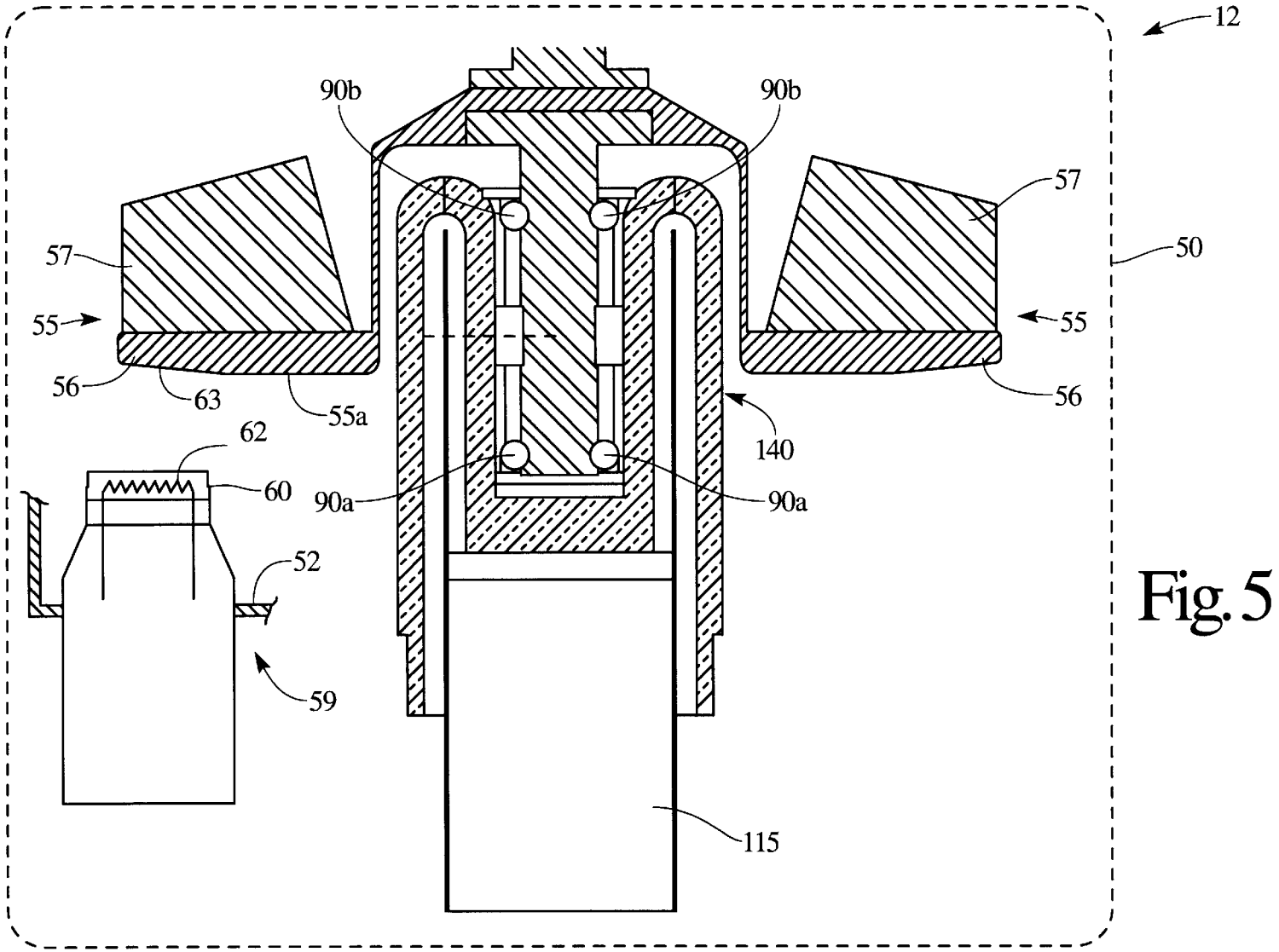
FIG. 5 is an x-ray tube in accordance with an alternative embodiment of the present invention.

Referring now to FIG. 5, another embodiment of the present invention is shown wherein the cathode assembly 55 is located on an opposite side of the x-ray tube 12. To accommodate the new positioning of the cathode assembly 55, the back plate 57 of the anode assembly 55 is moved to an opposite side of the front plate 56. This in turn also defines the anode surface 55*a* to be on the opposite side of the front plate 56 as shown. The straddle bearing assembly 140 of the present embodiment supports the newly configured anode assembly 55 is substantially the same manner as the bearing assembly 68 shown above in FIGS. 2–4 except that the positioning of the bearings 90*a*, 90*b* in the bearing assembly 140 takes into account the new location of the center of mass of the rotating assembly 79.

The invention has been described with reference to the preferred embodiments. Obviously, modifications and alterations will occur to others upon reading and understanding the preceding detailed description. For instance, referring to FIG. 2, although the motor 80 is shown to reside on a side of the x-ray tube in which the cathode assembly 59 resides, it is possible to move the motor 80 to the opposite side of the x-ray tube. Further, although the x-ray tube of the present invention is described to be bipolar, the x-ray tube could optionally be configured with uni-polar characteristics where the cathode is at a −150,000 volt electrical potential and the anode is at ground potential. It is intended that the invention be construed as including all such modifications and alterations insofar as they come within the scope of the appended claims or their equivalence thereof.

What is claimed is:

1. A straddle bearing assembly, comprising:

a first bearing and a second bearing disposed in a bearing housing on opposite sides of a center of mass of a rotating assembly, said rotating assembly including a target; and wherein a first thermally conductive path between the first bearing and the target includes a second thermally conductive path between the second bearing and the target.

2. The straddle bearing assembly of claim 1, wherein the target is an x-ray tube anode assembly.

3. The straddle bearing assembly of claim 2, wherein the bearing housing defines a cooling duct.

4. The straddle bearing assembly of claim, 3, wherein a portion of the bearing housing is made of glass and a portion of the bearing housing is made of metal.

5. The straddle bearing assembly of claim 1, wherein the rotating assembly further includes a shaft coupled to the target and the rotatably supported by the first bearing and by the second bearing.

6. The straddle bearing assembly of claim 5, wherein one of the bearings supports more of the rotating assembly's load than the other.

7. The straddle bearing assembly of claim 5, wherein the target includes an elongated portion.

8. The straddle bearing assembly of claim 7, wherein the elongated portion thermally grows in a direction substantially opposite to a direction of thermal growth of the shaft.

9. The straddle bearing assembly of claim 1 wherein the first bearing and the second bearing are positioned on a same side of the anode assembly.

10. An x-ray tube straddle bearing assembly, comprising:

a bearing housing, including:

a first elongated portion;

a second elongated portion coupled to the first elongated portion; and a base portion coupled to the second elongated portion; and a plurality of bearings disposed in the bearing housing for rotatably supporting a rotating assembly;

wherein the first elongated portion and the second elongated portion pass through a center of mass of the rotating assembly.

11. The x-ray tube straddle bearing assembly of claim 10, wherein the first elongated portion and the second elongated portion define a cooling duct.

12. The x-ray tube straddle bearing assembly of claim 11, wherein at least a portion of the first elongated portion is made of glass and at least a portion of the second elongated portion is made of metal.

13. The x-ray tube straddle bearing assembly of claim 11, wherein the second elongated portion and the base portion define a cavity.

14. The x-ray tube straddle bearing assembly of claim 13, wherein a first of the bearings is disposed in the cavity on a first side of the center of mass of the rotating assembly and a second of the bearings is disposed in the cavity on an opposite side of the center of mass of the rotating assembly.

15. The x-ray tube straddle bearing assembly of claim 14, wherein cooling fluid flowing through the cooling duct cools the first bearing and the second bearing through the second elongated portion.

16. The x-ray tube straddle bearing assembly of claim 15, wherein the cooling fluid is oil.

17. The x-ray tube straddle bearing assembly of claim 10, wherein the second elongated portion and the base portion define a cavity, and wherein a first of the bearings is disposed in the cavity on a first side of the center of mass of the rotating assembly and a second of the bearings is disposed in the cavity on an opposite side of the center of mass of the rotating assembly.

18. The x-ray tube straddle bearing assembly of claim 17, wherein the first bearing and the second bearing are on a same side of the anode assembly.

19. A method of improving performance of an x-ray tube, comprising the steps of:

positioning a first bearing of the bearing assembly on a first side of a center of mass of a rotating assembly, the rotating assembly including an anode assembly; and positioning a second bearing of the bearing assembly on an opposite side of the center of mass of the rotating assembly such that independent of an amount of load of the rotating assembly supported by the second bearing, the first bearing is in a closer thermal conductive path to the anode assembly than the second bearing.

20. An x-ray tube, comprising:

a cathode assembly;

an anode assembly;

a shaft coupled to the anode assembly;

an envelope defining a substantially evacuated chamber in which the cathode assembly and the anode assembly may operate and produce x-rays; and a straddle bearing assembly rotatably supporting the shaft and anode assembly, wherein the shaft enters the straddle bearing assembly from one side.

21. The x-ray tube of claim 20, wherein the straddle bearing assembly includes:

a bearing housing;

a first bearing disposed in the bearing housing on a first side of a center of mass of a rotating assembly, the rotating assembly including the anode assembly; and a second bearing disposed in the bearing housing on an opposite side of the center of mass of the rotating assembly.

22. The x-ray tube of claim 21, wherein the first bearing is coupled to the anode assembly via a first thermally conductive path and the second bearing is coupled to the anode assembly via a second thermally conductive path, and wherein the second thermally conductive path includes the first thermally conductive path.

23. An apparatus for taking images of a patient, comprising:

an x-ray tube, including:

a cathode assembly;

a rotating assembly, the rotating assembly including an anode assembly;

an envelope defining a substantially evacuated chamber in which the cathode assembly and the anode assembly operate to produce x-rays; and a bearing assembly, including;

a first bearing disposed in a bearing housing on a first side of a center of mass of the rotating assembly, the first bearing coupled to the anode assembly via a first thermally conductive path; and a second bearing disposed in the bearing housing on an opposite side of the center of mass of the rotating assembly, the second bearing coupled to the anode assembly via a second thermally conductive path;

wherein the second thermally conductive path is longer then the first thermally conductive path independent of an amount of load of the rotating assembly supported by the second bearing; and a means for supporting the x-ray tube.

24. The apparatus of claim 23, wherein the rotating assembly further includes a shaft coupled to the anode assembly and rotatably supported by the bearing assembly.

25. The apparatus of claim 24, wherein the shaft defines a first inner race for receiving the first bearing and a second inner race for receiving the second bearing.

26. The apparatus of claim 23 wherein the means for supporting the x-ray tube is a gantry of a CT scanner.

27. An x-ray tube straddle bearing assembly, the x-ray tube straddle bearing assembly supporting a rotating assembly including a target, the x-ray tube straddle bearing assembly comprising:

a bearing housing;

a first bearing disposed in the bearing housing and coupled to the target via a first thermally conductive path, the first bearing positioned on a first side of a center of mass of the rotating assembly; and a second bearing disposed in the bearing housing and coupled to the target via a second thermally conductive path, the second bearing positioned on an opposite side of the center of mass of the rotating assembly;

wherein the first bearing supports less of a load of the rotating assembly than the second bearing and the first thermally conductive path is shorter than the second thermally conductive path.

28. The x-ray tube straddle bearing assembly of claim 27, wherein the rotating assembly is an x-ray tube anode assembly.

29. The x-ray tube straddle bearing assembly of claim 28, wherein the bearing housing defines a cooling duct.

30. The x-ray tube straddle bearing assembly of claim, 29, wherein a portion of the bearing housing is made of glass and a portion of the bearing housing is made of metal.

31. A method of improving performance of an x-ray tube, the x-ray tube including a rotating assembly and a cathode assembly, the rotating assembly including an anode assembly and a shaft coupled to the anode assembly, the shaft rotatably supported by a bearing assembly and defining a first inner race and a second inner race, the method comprising the steps of:

positioning a first bearing between the first inner race and a first outer race of the bearing assembly, the first bearing positioned on a first side of a center of mass of the rotating assembly;

positioning a second bearing between the second inner race and a second outer race of the bearing assembly, the second bearing positioned on an opposite side of the center of mass of the rotating assembly; and rotating the shaft about an axis of rotation.

32. The method of 31, wherein the anode assembly includes an elongated portion.

33. The method of claim 31, wherein the first bearing is in a closer thermally conductive path to the anode assembly than the second bearing independent of an amount of load of the rotating assembly supported by the second bearing.

* * * * *